United States Patent [19]

Letica

[11] 4,293,080

[45] Oct. 6, 1981

[54] CONTAINER CONSTRUCTION

[75] Inventor: Ilija Letica, Oxford, Mich.

[73] Assignee: Letica Corporation, Rochester, Mich.

[21] Appl. No.: 169,330

[22] Filed: Jul. 16, 1980

[51] Int. Cl.[3] ..... B65D 41/16; B65D 41/18

[52] U.S. Cl. ..... 220/306; 220/307; 220/72; 220/74; 220/355

[58] Field of Search ..... 220/72, 74, 306, 307, 220/355

[56] References Cited

U.S. PATENT DOCUMENTS 3,977,563 8/1976 Holt ..... 220/306

4,210,258 7/1980 Von Holdt ..... 220/307 X

*Primary Examiner*—George T. Hall

*Attorney, Agent, or Firm*—Krass, Young & Schivley

[57] ABSTRACT

A resealable, cylindrical plastic container assembly formed from high density thermoplastic includes a novel rim and lid interlock construction which provides an improved rim-to-lid seal. The container includes a plurality of circumferential and longitudinal reinforcement ribs adjacent the rim which are inset into the container sidewalls so as to avoid protuberances therefrom. A connecting flange above the reinforcement ribs supports the rim and provides a firm surface for supporting a pry tool used to remove the lid from the container. The rim comprises an exterior sealing bead and an interior locking lip connected by a substantially flat, inclined sealing surface. The lid is provided with interior and exterior locking portions defining a channel which grips and conformingly engages the rim to provide a fluid tight seal between the bead and locking lip of the container. Circumferentially spaced notches in the connecting flange provide access to a pry opening between the flange and the lid to facilitate removal of the lid.

19 Claims, 4 Drawing Figures

CONTAINER CONSTRUCTION

TECHNICAL FIELD

The present invention generally relates to container assemblies, especially those molded from plastic material, and deals more particularly with a lid-to-container interlock for providing a fluid tight seal between the rim and container.

BACKGROUND ART

Containers such as buckets and pails of unitary construction molded from plastic materials have become more widespread in use during recent years, due in part to the fact that they may be economically produced in large quantities. Molded plastic containers have replaced many types of previous metal constructions except in those applications where hazardous materials such as paints and thinners are intended to be packaged; these latter mentioned applications demand that the container be exceptionally rigid and not subject to rupture or leakage during shipping or ordinary use. Molded plastic containers have not been entirely successful in replacing metal constructions because prior art container-to-lid interlocks have not been entirely reliable in providing a seal which precludes leakage of the contents from the container. Although interlocks, such as that disclosed in U.S. Pat. No. 3,977,563, have previously been designed which form an essentially fluid tight seal under ordinary conditions of use, such seal may be easily broken and the lid inadvertently removed from the container if the rim is flexed.

Containers, such as those used to package paint and the like, are desirably formed with essentially smooth sidewalls, free of protuberances, so that the containers may be placed in side-by-side relationship to each other in a minimum amount of space. Reinforcement ribs, as shown in the disclosure of U.S. Pat. No. 3,977,563, extend radially outward beyond the sidewalls of the container and therefore increased the amount of space needed to package a number of such containers for shipping and storage purposes.

Another disadvantage of prior art containers of the type mentioned above resides in the fact that such containers possess relatively little axial strength adjacent the rim thereof, compared to metal constructions. Weakness in the rim in the axial direction results in the rim flexing or bowing, or otherwise deforming when a lid is either pried from, or applied to, the container under pressure.

Accordingly, it is an important object of the present invention to provide a molded plastic container assembly having an improved rim-to-lid interlock which provides a positive, reliable fluid tight seal even when subjected to rough handling, as during shipping thereof.

A further important object of the invention is to provide a container assembly of the type mentioned above which exhibits improved rigidity in the axial direction adjacent the rim, so as to preclude flexing of the rim during installation or removal of a lid from the container.

A still further object of the invention is to provide a container assembly as described above which is provided with longitudinal and circumferential reinforcement ribs adjacent the rim of the container which are inset into the container sidewalls, such that such sidewalls exhibit an essentially smooth, uninterrupted profile.

These and further objects of the invention will be made clear or will become apparent during the course of the following description of a preferred embodiment of the invention.

SUMMARY OF THE INVENTION

A resealable, cylindrical plastic container assembly molded from high density thermoplastic is provided with a novel rim and lid interlock construction which provides an extremely reliable rim-to-lid seal which may be broken only with the use of a specially configured tool. The container includes a plurality of circumferential and longitudinal reinforcement ribs adjacent the rim thereof which are inset into the container sidewalls so as to provide the sidewalls with a continuous, uninterrupted profile. A connecting flange above the reinforcement ribs supports a rim and provides a firm surface for supporting a pry tool used to remove the lid from the container. The rim comprises an exterior sealing bead and an interior locking lip connected by a substantially flat, inclined sealing surface. The lid includes interior and exterior locking portions defining a channel which grips and conformingly contacts the rim to provide a fluid tight seal between the bead and locking lip. Circumferentially spaced notches in the connecting flange are aligned with the vertical reinforcement ribs and provide access to a pry opening between the connecting flange and the lid.

BRIEF DESCRIPTION OF THE DRAWINGS

In the drawings, which form an integral part of the specification and are to be read in conjunction therewith, and in which like components are designated by identical reference numerals in the various views.

DETAILED DESCRIPTION OF THE INVENTION

Figure 1:
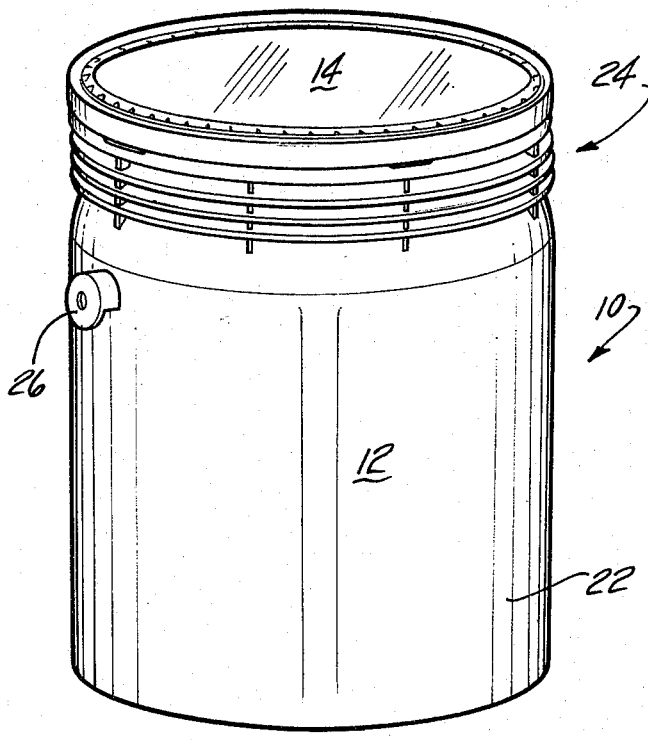
FIG. 1 is a top perspective view of the container construction which forms the preferred embodiment of the present invention, with the lid installed in interlocking, sealed relationship on the container rim.
Figure 2:
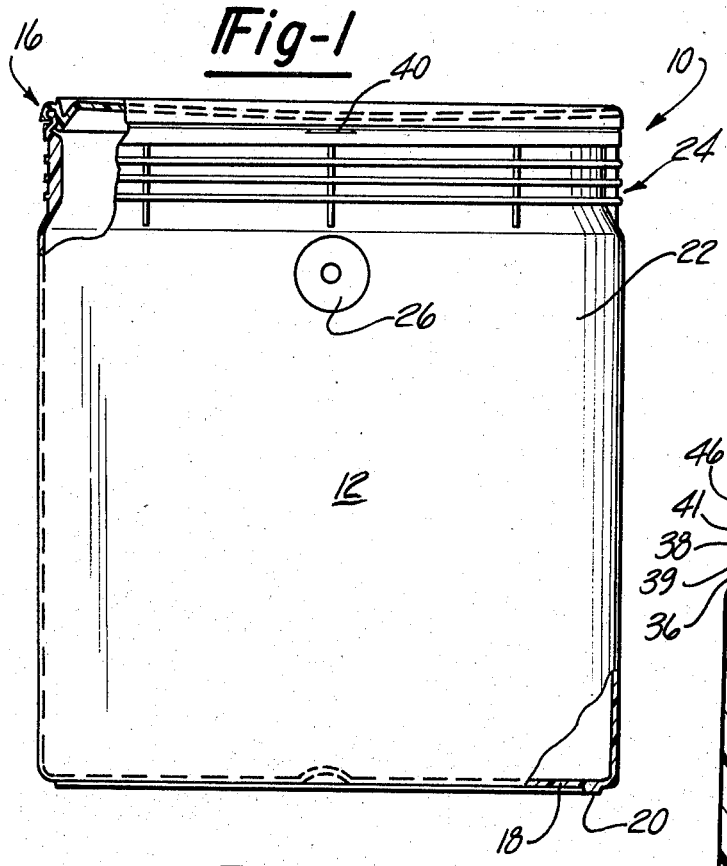
FIG. 2 is a side view of the container construction shown in FIG. 1, with parts being broken away in section for purposes of clarity.
Figure 3:
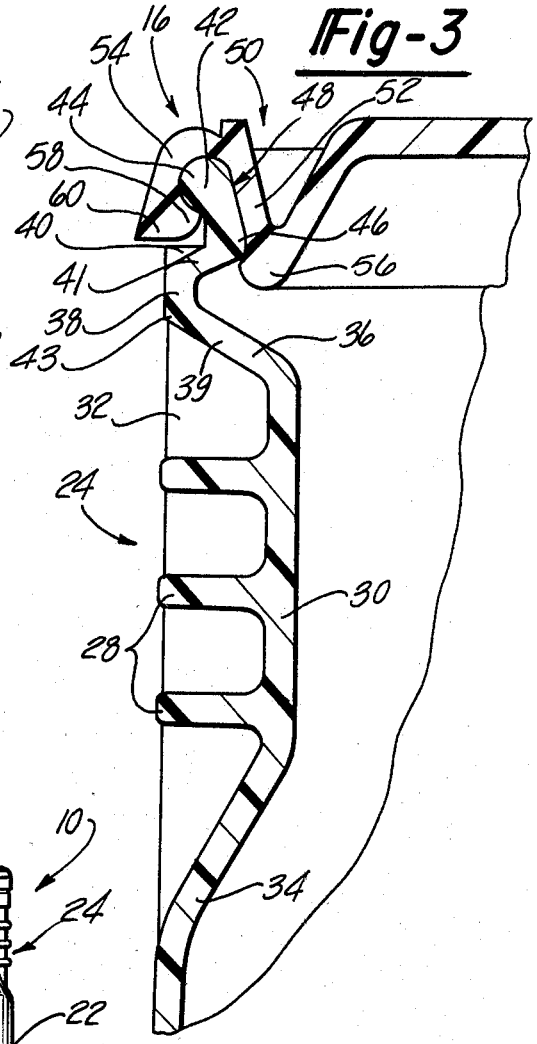
FIG. 3 is a fragmentary cross sectional view of the interlock between the container rim and lid of the container construction shown in FIGS. 1 and 2.
Figure 4:
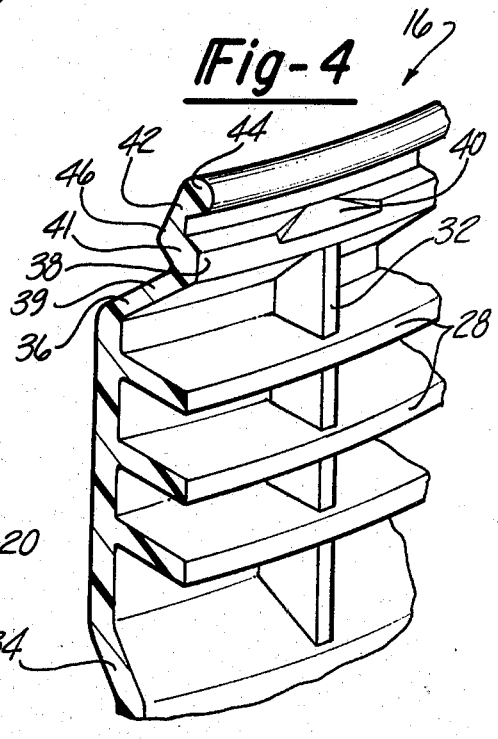
FIG. 4 is a fragmentary, sectional view, taken in perspective of a portion of the container sidewall and rim, with the lid having been removed from the container.

Referring now to the drawing, a molded plastic container assembly, generally indicated by the numeral 10 comprises a cylindrically shaped container 12 having a circular lid 14 connected to the top thereof by interlock means 16.

The container 12 is preferably injection molded from thermoplastic material, such as polyethylene, and possesses a density of 0.947 to 0.965 grams per cubic centimeter. The melt index of the thermoplastic material is preferably between 3 and 18 melt. The container 12 is provided with a circular bottom wall 18 having a peripheral, downwardly depending stacking flange 20 formed integral therewith. A cylindrically shaped sidewall 22 extends upwardly from bottom wall 18 and includes a reinforcement section, or neck portion generally indicated at 24 adjacent the open top thereof. A pair of handle brackets 26 are formed integral with the sidewall 22, on opposite sides thereof, and are adapted for mounting a conventional handle (not shown) on the container 12.

The reinforcement section 24 is defined by an inset in the sidewall 22, such that the inside diameter of sidewall 22 opposite the reinforcement section 24 is less in magnitude than the inside diameter of the sidewall 22 below the reinforcement section 24. Reinforcement section 24 is defined by a plurality of longitudinally spaced, essentially parallel, circumferentially extending reinforcement ribs 28 which extend radially outward from a connecting wall 30 to a point substantially even with the profile defined by the exterior surface areas of sidewall 22. The reinforcement section 24 further includes a plurality of longitudinally extending, circumferentially spaced vertical reinforcement ribs 32 which extend transverse to ribs 28 and are connected to inset walls 34 and 36. Ribs 28 and 32 each extend radially transverse to sidewall 22, thereby imparting both longitudinal and circumferential rigidity to the top of the container 12.

A connecting flange 38 extends upwardly from the reinforcement section 24. Connecting flange 38 is a U-shaped circumferential ridge including a first leg 39 which extends from inset wall 36 upwardly and radially outward. Said connectng flange further includes a second leg 41 which extends radially inward from the upper end 43 of said first leg 39. Said second leg 41 is provided with a plurality of access notches 40 therein which are circumferentially aligned in registration above vertical reinforcement ribs 32 and present downwardly inclined surface areas adjacent the outer edge of flange 38. A rim 42 extends upwardly from flange 38 and defines the circular open top of the container 12. Rim 42 comprises a semi-circular shaped bead 44 on the upper extremity thereof, extending radially outward and spaced above the flange 38. An arcuately shaped locking lip 46 is defined on the opposite extremity of rim 42, interior of the container 12. Bead 44 and locking lip 46 are connected by a substantially flat, inclined sealing surface 48 extending therebetween inside the container 12.

The lid 14 is formed of flexible thermoplastic material and is provided with a V-shaped stacking groove 50 near the periphery thereof which is adapted to matingly receive the stacking flange 20 when the containers 10 are stacked upon each other. Lid 14 includes a locking channel defined by a pair of spaced legs 52 and 54 adapted to grip and conformingly engage the rim 42 therebetween. The channel includes an interior locking portion 56 defined by interior locking edges which conformingly grip locking lip 46, and an exterior locking portion 58 including exterior locking edges conformingly engaging essentially the entire periphery of the bead 44. Leg 54 is provided with a prying flange 60 which extends radially outward beyond the sidewall 22. Prying flange 60 is spaced slightly above the connecting flange 38 so as to define an access opening between the lid 14 and container 12 at the notches 40. Leg 52 of the lid channel presents an interior wall surface which contacts essentially the entire sealing surface 48, while leg 54 contacts essentially the entire surface area presented by bead 44. Thus, it is apparent, that a seal of substantial area is formed between the rim 42 and interlocking peripheral channel defined in the lid 14.

In use, the lid 14 may be installed on the container 12 by applying a vertical, downwardly directed force along the lid channel; by virtue of the flexibility of lid 14, legs 52 and 54 flex away from each other upon engagement with rim 42 until the interior and exterior locking portions 56 and 58 clear the locking lip 46 and bead 44. At this point, legs 52 and 54 spring inwardly and the interior and exterior locking portions 56 and 58 conformingly grip the locking lip 46 and bead 44 to form an exceptionally tight seal between the container 12 and lid 14. By virtue of the fact that the reinforcement section 24 is inset in the sidewalls 22 of the container 12, a plurality of the container assemblies 10 may be disposed in side-by-side relationship in a minimum amount of space since the sides of each container assembly 10 are essentially free from protuberances.

In order to remove the lid 14 from the container 12, a prying tool (not shown) such as a screw driver is inserted between the prying flange 60 and connecting flange 38 at one of the notches 40. The inclined surface areas of the notch 40 allows penetration of the prying tool such that the exterior locking portion 58 of the lid 14 may be engaged and pried away from the bead 44. Continued upward prying force applied to the periphery of the lid 14 breaks the seal, especially along the sealing surface 48 until a section of the interior locking portion 56 is urged into clearing relationship to the locking lip 46; at this point, the prying tool may be inserted into another adjacent notch 40, and the prying process repeated until the seal is broken substantially around the entire periphery of the lid 14.

As the lid 14 is removed and re-installed on the container 12, the vertical reinforcement ribs 32 provide the container rim with added rigidity in an axial direction so as to prevent flexion or deformation thereof. The circumferential reinforcement ribs 28 provide the container rim with added hoop strength, which likewise reduces flexion or distortion. The cooperation of the first leg 39 and second leg 41 of the connecting flange 38 prevents the rim 42 from flexing due to the force of a prying tool bearing on said connecting flange.

From the foregoing, it is apparent that the container assembly and novel interlock described above not only provide for the reliable accomplishment of the objects of the invention, but do so in a particularly economical and effective manner. It is recognized, of course, that those skilled in the art may make various modifications or additions to the preferred embodiment chosen to illustrate the invention without departing from the scope and spirit of the present contribution to the art. Accordingly, it is to be understood that the protection sought and to be afforded hereby should be deemed to extend to the subject matter claimed and all equivalents thereof fairly within the scope of the invention.

Having thus described the invention, what is claimed is:

1. A resealable plastic container assembly, comprising:

a generally cylindrical container having a bottom, a sidewall extending upwardly from said bottom and an open top, said container including:

(1) a plurality of circumferential reinforcement ribs adjacent said top thereof, said ribs being defined within a radially inset area in said sidewall, the outside diameter of each of said ribs being substantially equal to or less than the outside diameter of said side wall below said inset area, (2) a connecting flange above said circumferential ribs extending upwardly toward said open top, and (3) a rim connected to and disposed above said connecting flange, said rim having an arcuately shaped bead on the upper extremity thereof extending radially outward and defining said open top, a locking lip on the opposite end of said rim and interior of said container, and a substantially flat sealing surface essentially interior of said container and extending between said container and extending said bead and said locking lip to provide a continuous seal between said bead and said locking lip; and, a lid for removable attachment to said container comprising a substantially flat disc having a channel in the periphery thereof adapted to receive said rim therewithin, said channel being defined by—

(1) a substantially flat wall surface adapted to sealingly engage said flat sealing surface and being essentially coextensive with the latter, (2)an interior locking portion on the lower extremity of said flat wall surface and including an arcuately shaped interior locking edge adapted to conformingly grip said locking lip, and (3) an exterior locking portion on the upper extremity of said flat wall surface and including an arcuately shaped exterior locking edge adapted to conformingly engage and grip said bead, said exterior locking edge being spaced from said connecting flange to define a pry opening between said lid and said container rim into which a tool may be inserted for removing said lid, said rim and said channel providing a tight, continuous lid-to-container seal between said exterior and interior locking portions of said lid.

2. The container assembly of claim 1, wherein said container comprises a thermoplastic material having a density from 0.947 to 0.965 grams per cubic centimeter.

3. The container assembly of claim 1, wherein said container further includes a plurality of circumferentially spaced, vertical reinforcement ribs defined in said inset area and extending transverse to and being connected with said circumferential reinforcement ribs and said connecting flange.

4. The container assembly of claim 1, wherein the inside diameter of said sidewall opposite said circumferential reinforcement ribs is less in magnitude than the inside diameter of said sidewall below said ribs.

5. The container assembly of claim 3, wherein said exterior locking portion includes a prying flange adjacent said exterior locking portion and extending radially outward beyond said connecting flange.

6. The container assembly of claim 1, wherein said bead on said rim presents an arcuate surface extending essentially 180 degrees in cross section.

7. The container assembly of claim 5, wherein said connecting flange is provided with a plurality of circumferentially spaced notches in the periphery thereof opposing said prying flange for providing access to said pry opening.

8. The container assembly of claim 7, wherein said vertical reinforcing ribs are circumferentially aligned in registration with said notches.

9. A resealable plastic container assembly, comprising:

a generally cylindrical container having a bottom, a sidewall extending upwardly from said bottom and an open top, said container including—

(1) a connecting flange above said sidewall extending upwardly toward said open top, and (2) a rim connected to and disposed above said connecting flange, said rim having an arcuately shaped bead on the upper extremity thereof extending radially outward and defining said open top, a locking lip on the opposite end of said rim and interior of said container, and a continuous sealing surface essentially interior of said container and extending between said bead and said locking lip to provide a continuous seal between said bead said locking lip, (3) means for reinforcing the top of said container, said reinforcement means being defined in a radially inset area in said sidewall and extending circumferentially around said container, the maximum diameter of said reinforcing means being equal to or less than the diameter of said sidewall below said connecting flange; and, a lid for removable attachment to said container comprising a substantially flat disc having a channel in the periphery thereof adapted to receive said rim therewithin, said channel being defined by:

(1) a continuous wall surface adapted to sealingly engage said continuous sealing surface and being essentially coextensive with the latter, (2) an interior locking portion on the lower extremity of said continuous wall surface and including an arcuately shaped interior locking edge adapted to conformingly grip said locking lip, and (3) an exterior locking portion on the upper extremity of said continuous wall surface and including an arcuately shaped exterior locking edge adapted to conformingly engage and grip said bead, said exterior locking edge including a prying flange extending radially outwardly therefrom and, being spaced from said connecting flange to define a pry opening between said prying flange and said connecting flange into which a tool may be inserted for removing said lid, said rim and said channel providing a tight, continuous lid-to-container seal between said exterior and interior locking portions of said lid.

10. The container assembly of claim 9 wherein said reinforcing means includes a plurality circumferially extending, longitudinally spaced reinforcement ribs.

11. The container assembly of claim 10 wherein said reinforcing means further includes a plurality of circumferentially spaced, longitudinal reinforcement ribs, said longitudinal reinforcement ribs extending transverse to and being connected with said circumferential reinforcement ribs.

12. The container assembly of claim 11 wherein said connecting flange is provided with a plurality of notches circumferentially aligned with said longitudinal reinforcement ribs in the exterior of said connecting flange opposite said prying flange for providing access to said pry opening.

13. The container assembly of claim 9 wherein said connecting flange comprises a substantially U-shaped circumferential ridge including a first leg which extends upwardly and radially outward from said sidewall, a second leg extending upwardly and radially inward from the upper end of said first leg to said locking lip, said first and second leg cooperating to prevent said rim from flexing under the force applied thereto by a prying tool bearing on said connecting flange.

14. An injection molded thermoplastic pail having an open end and comprising:

a cylindrical body having substantially constant inner and outer diameters along the primary length thereof;

a neck portion integral with the body, adjacent the open end and having an inner diameter which is less than the inner diameter of the body and an outer diameter which is no greater than the outer diameter of the body;

a plurality of axially spaced circumferential reinforcing rings integrally formed into said neck portion; and a plurality of circumferentially spaced, axial reinforcing ribs integrally formed into said neck portion and integrally intersecting said circumference rings, the outer diameter of said pail including said body and said neck portion being substantially constant along the length thereof.

15. A unitary plastic container, comprising:

a substantially cylindrical body having a bottom, sidewall extending upwardly from said bottom, and an open top, said body further having a neck portion radially inset relative to said sidewall and disposed adjacent said open top, the maximum outside diameter of said neck portion being substantially no greater than the outside diameter of said sidewall, said neck portion including radially extending rib means for reinforcing said body adjacent said open top.

16. The container of claim 15, wherein said rib means extends around essentially the entire circumference of said body.

17. The container of claim 16, wherein said neck portion includes a connecting wall and said rib means includes a plurality of longitudinally spaced, circumferential rib members, each of said rib members being joined integral at their respective inner extremities to said connecting wall.

18. The container of claim 17, wherein said rib means includes a plurality of circumferentially spaced, longitudinally extending rib members integrally intersecting said circumferential rib members.

19. The container of claim 15, wherein said body is provided with a rim defining said open top of said container and a connecting flange between said rim and said neck portion.

* * * * *